US007544173B2

(12) United States Patent
Suzuki

(10) Patent No.: US 7,544,173 B2
(45) **Date of Patent: *Jun. 9, 2009**

(54) MASSAGE MACHINE ADAPTED TO STRETCH LEGS USING INFLATABLE AIR BAGS

(75) Inventor: Takamasa Suzuki, Kasai (JP)

(73) Assignee: Sanyo Electric Co., Ltd., Osaka (JP)

( * ) Notice: Subject to any disclaimer, the term of this patent is extended or adjusted under 35 U.S.C. 154(b) by 337 days.

This patent is subject to a terminal disclaimer.

(21) Appl. No.: 11/156,429

(22) Filed: Jun. 20, 2005

(65) Prior Publication Data

US 2005/0288612 A1 Dec. 29, 2005

(30) Foreign Application Priority Data

Jun. 25, 2004 (JP) ..... 2004-187143

(51) Int. Cl.
*A61H 1/02* (2006.01)
*A61H 23/04* (2006.01)

(52) U.S. Cl. ..... 601/24; 601/26; 601/29; 601/28; 601/98; 601/105; 601/149

(58) Field of Classification Search ..... 601/98, 601/101, 103–105, 148–151, 24, 26, 27, 601/28, 29
See application file for complete search history.

(56) References Cited

U.S. PATENT DOCUMENTS

2004/0186399 A1* 9/2004 Tseng ..... 601/112
2004/0236257 A1* 11/2004 Hsieh ..... 601/127
2005/0033204 A1* 2/2005 Nakamura et al. ..... 601/103
2005/0234371 A1* 10/2005 Kurata et al. ..... 601/34
2007/0016119 A1* 1/2007 Inada et al. ..... 601/151

FOREIGN PATENT DOCUMENTS

JP 2003310685 11/2003
JP 2004129896 4/2004
JP 2004135737 5/2004

OTHER PUBLICATIONS

European Search Report, Aug. 24, 2005, Entire document.

* cited by examiner

*Primary Examiner*—Danton DeMille
(74) *Attorney, Agent, or Firm*—Carol A. Mamo, Esquire; Eckert Seamans Cherin & Mellott, LLC

(57) ABSTRACT

A massage machine is provided which is adapted to stretch the legs of the user as seated in a chair on opposite sides of the leg. Side air bags (11) inflatable and contractable by being supplied with air and releasing the air therefrom are provided as holding means on opposite side walls defining each cavity (6) of a legrest (7) for placing the leg thereinto. Side air bags (16), (17) serving as means for moving the foot leftward or rightward are provided on opposite side walls of each cavity (15) of a footrest (8) for placing the foot thereinto. Control means alternately inflates the side air bags (16), (17), with the leg held between the side air bags (11) as inflated, to move the foot leftward or rightward. As a result, the leg is tensioned and stretched on the side thereof opposite to the direction of movement of the foot.

2 Claims, 6 Drawing Sheets

MASSAGE MACHINE ADAPTED TO STRETCH LEGS USING INFLATABLE AIR BAGS

FIELD OF THE INVENTION

The present invention relates to massage machines comprising a legrest provided in front of the seat of a chair for the user to place his or her legs thereinto, and a footrest provided at the forward end of the legrest for the user to place his or her feet thereinto.

BACKGROUND OF THE INVENTION

Massage machines are known which comprise a legrest provided in front of the seat of a chair for the user to place his or her legs thereinto, and a footrest provided at the forward end of the legrest for the user to place his or her feet thereinto as disclosed in the publication of JP-A No. 2004-129896.

With the massage machine disclosed in this publication, the legrest and the footrest each comprise a pair of gutterlike cavities for placing the legs or feet thereinto, and side air bags provided on respective opposite side walls defining each of the cavities are inflated or contracted by being supplied with air or releasing the air therefrom to massage the leg or foot by pressing on their side portions. Bottom air bags are provided also on the bottom wall of each cavity and inflated or contracted by being supplied with air or releasing the air therefrom so as to press on the rear side of the calf or the sole for massaging.

However, the massage machine disclosed in the above publication is unable to stretch the opposite sides of the leg.

An object of the present invention is to provide a massage machine which is capable of stretching the legs of the user as seated in a chair on opposite sides of the legs.

SUMMARY OF THE INVENTION

To fulfill the above object, the present invention provides a massage machine comprising a legrest provided in front of a seat of a chair for the user to place his or her legs thereinto, and a footrest provided at a forward end of the legrest for the user to place his or her feet thereinto. The massage machine comprises holding means provided in the legrest for holding each leg of the user therebetween from opposite sides thereof, moving means provided in the footrest for moving each foot of the user leftward or rightward, and control means for controlling the movement of the holding means and the moving means, the control means being operable to operate the moving means with the leg held by the holding means to move the foot leftward or rightward.

With the massage machine described above, the moving means is operated by the control means to move the foot leftward or rightward with the leg held by the holding means, so that the leg is stretched on one side thereof opposite to the direction of movement of the foot, with the muscle on the side portion tensioned.

The legrest has a pair of gutterlike cavities for the user to place his or her legs thereinto, and side walls defining each of the cavities can be provided with side air bags serving as the holding means and inflatable and contractable by being supplied with air and releasing the air therefrom.

When the side air bags of the legrest are inflated, the leg can be held in the cavity of the legrest. In addition to holding the leg, the side air bags give a massage to the leg by pressing the leg on opposite sides thereof and relieving the leg of the pressure when repeatedly inflated and contracted.

The legrest has a pair of gutterlike cavities for the user to place his or her legs thereinto, and the holding means comprises a holding plate disposed along each of side walls defining each of the cavities and movable leftward or rightward The holding plate can be moved leftward or rightward by a motor.

By moving the holding plate by the motor inwardly of the cavity, the leg can be held between the holding plates inside the cavity of the legrest.

The footrest has a pair of gutterlike cavities for the user to place his or her feet thereinto, and the moving means comprises two side air bags arranged on respective opposite side walls defining each of the cavities and inflatable and contractable by being supplied with air and releasing the air therefrom. The two side air bags can be inflated alternately by the control means.

By alternately inflating the side air bags provided on opposite side walls of the cavity of the footrest, the foot can be moved toward one side opposite to the inflated side air bag, and the leg is stretched on the side thereof opposite to the direction of movement of the foot, with the muscle on the side portion tensioned. Furthermore, opposite sides of the leg can be stretched alternately by inflating the side air bags on opposite side walls alternately. In addition to moving the foot leftward or rightward, the side air bags give a massage to the foot by pressing the foot on the side thereof and relieving the foot of the pressure when repeatedly inflated and contracted.

The footrest has a pair of gutterlike cavities for the user to place his or her feet thereinto, and the moving means comprises two moving plates arranged on respective opposite side walls defining each of the cavities and movable leftward or rightward. The two moving plates can be moved alternately leftward or rightward by the control means.

By alternately moving the moving plates leftward or rightward which plates are provided on the respective side walls of the footrest cavity, the foot can be moved leftward or rightward to tension the muscle on the side portion of the leg opposite to the direction of movement of the foot, whereby the leg can be stretched over the side portion.

DESCRIPTION OF THE REFERRED EMBODIMENT

A massage machine of the invention will be described below with reference to the drawings.

Figure 1:
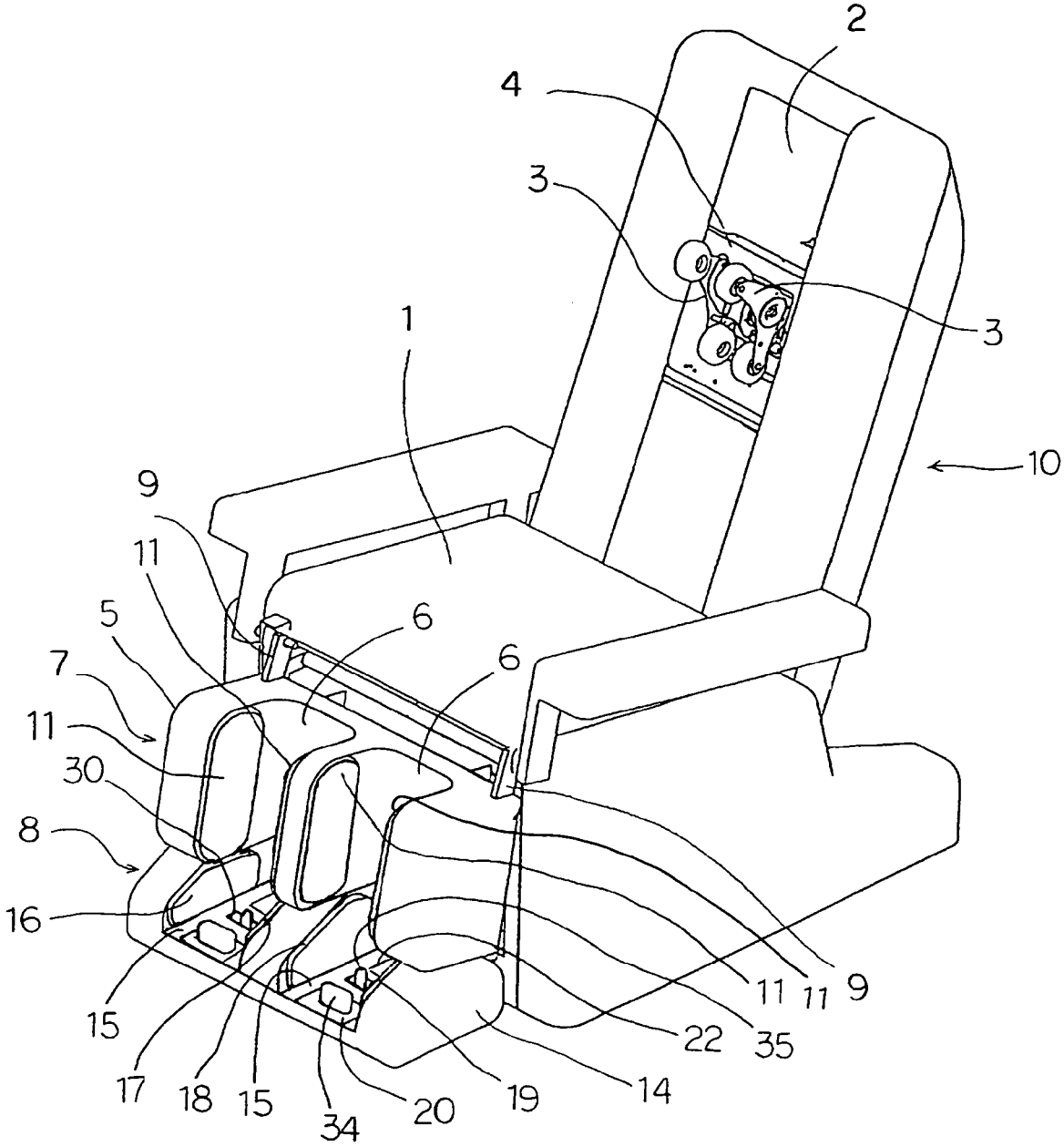
FIG. 1 is a perspective view of a massage machine of the invention.

The massage machine, which is indicated at 10 is of the chair type and has a legrest 7 disposed in front of a seat 1 and serving also as a leg massage unit, and a footrest 8 at the lower end of the legrest 7 and serving as a foot massage unit. Provided in a backrest 2 of the chair is a massage unit 4 which can be of the known type. As shown in FIG. 1, the massage unit 4 has, for example, a pair of left and right therapeutic fingers 3, 3 and is movable upward and downward along the backrest 2. The therapeutic fingers 3, 3 are movable toward and away from each other for giving a kneading massage to the person to be treated, i.e., to the user, and is pivotally movable upward and downward for a tapping massage. The backrest 2 is provided with an unillustrated cloth cover.

The legrest 7 serving also as the leg massage unit is connected by a connecting frame 9 to the front end of the seat 1 so as to be pivotally movable and positionable at a voluntary angle.

The legrest 7 comprises a unit case 5 made of a resin or the like and having a pair of gutterlike cavities 6, 6 for placing thereinto the legs (calves) of the user, and side air bags 11, 11 arranged respectively on opposed side walls defining each of the respective cavities 6, 6.

The side air bag 11 can be made from polyethylene or the like by blow molding. If the air bag 11 is completely adhered to the side wall of the cavity 6, stress will be created in the adhered portion of the side air bag 11 when the bag is inflated or contracted, so that the bag is attached only at a portion thereof to the side wall of the cavity 6.

The side air bags 11 are connected to an air pump 13 (see FIG. 6) through a piping tube (not shown) and an electromagnetic valve 12. The valve 12 selectively causes the air bags 11 to communicate with the air pump 13 or with the atmosphere by blocking the communication of the bags with the pump. When communicating with the air pump 13, the air bags 11 are supplied with air from the pump 13 and inflated. The air is released from the air bags 11 when the bags 11 communicate with the atmosphere. The calves of the person to be treated held in the cavities 6, 6 are pressed on their opposite sides and relieved of the pressure for a massage by repeating such inflation and contraction.

The four side air bags 11 provided in the legrest 7 are operated together by the single electromagnetic valve 12.

A cloth cover (not shown) is provided over the surface of the legrest 7, whereby the side air bags 11 can be held along the side walls of the cavities 6 while being prevented from falling inside the cavities 6 without being adhered to the side walls.

The footrest 8 serving also as a foot massage unit will be described next.

As shown in FIG. 1, the footrest 8 is pivotally movably connected to the forward end of the legrest 7. The footrest 8 is connected by an unillustrated link mechanism to the legrest 7 so as to be held in a substantially horizontal position (as shown in FIG. 1) at all times despite the pivotal movement of the legrest 7. The footrest 8 remains horizontal even if the legrest 7 is pivotally moved upward to substantially the same level as the seat 1. Accordingly, when the legrest 7 is pivotally moved to substantially the same level as the seat 1, the user as seated in the massage machine 10 can stretch out his or her legs toward the front.

With reference to FIG. 1, the footrest 8 comprises a resin unit case 14 provided with a pair of gutterlike cavities 15, 15 for the user to place his or her feet (the parts lower than the ankles) in, side air bags 16 to 19 provided on opposite side walls defining the cavities 15, 15, and three bottom air bags 20, 21, 22 provided on the bottom of each of the cavities 15, 15.

The side air bags 16 to 19 can be made from polyethylene or the like by blow molding. If the side air bags 16 to 19 are secured completely the side walls of the cavities 15 as by adhesion, a stress will be created in the adhered portions of the air bags 16 to 19 when the bags are inflated or contracted, so that the bags are fixed to the cavity side walls only partly.

Figure 6:
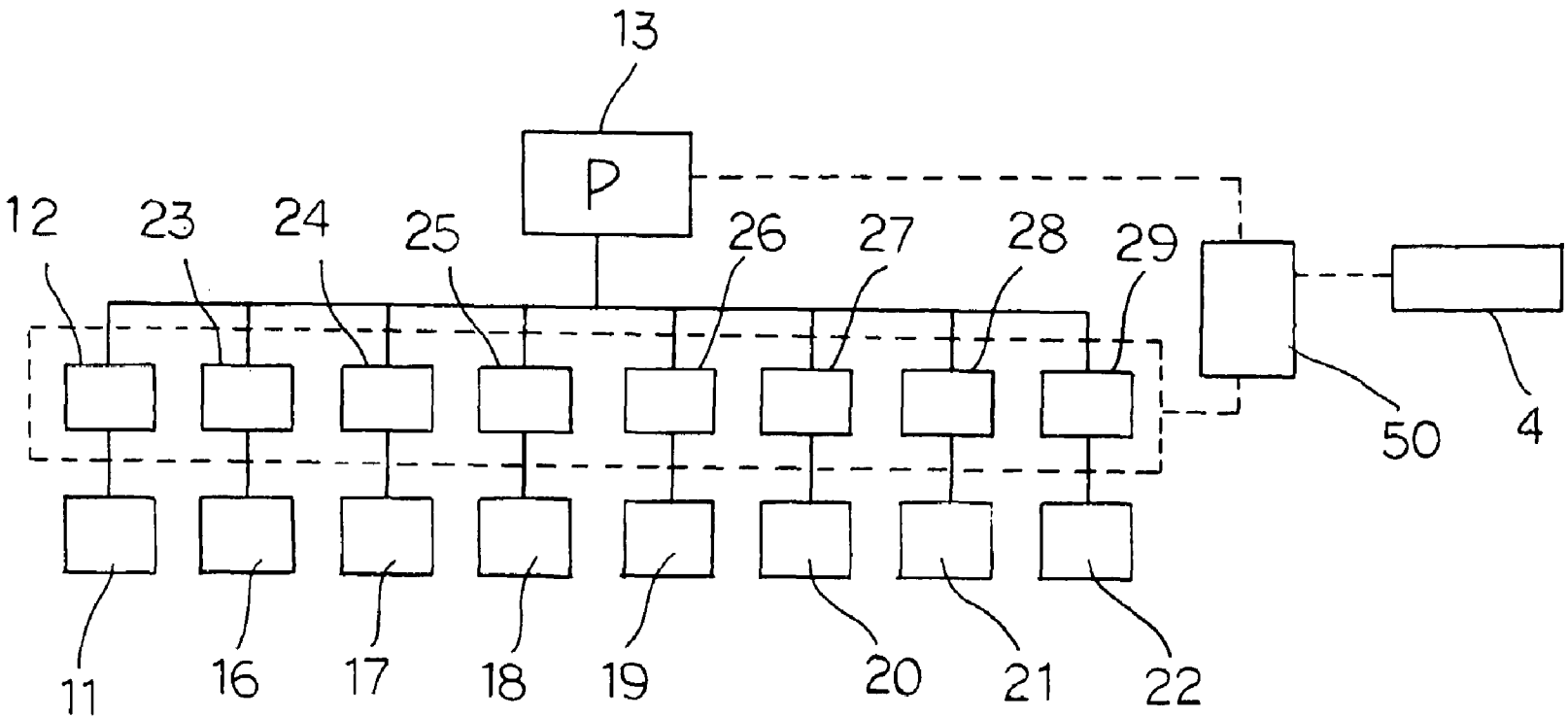
FIG. 6 is a diagram showing the electrical connection of control means and the connection between an air pump and air bags.

The four air bags 16 to 19 are connected to the air pump 13 respectively through piping tubes (not shown) and electromagnetic valves 23 to 26 (see FIG. 6). The valves 23 to 26 selectively cause the air bags 16 to 19 to communicate with the air pump 13 or with the atmosphere by blocking the communication of the bags with the pump. When communicating with the air pump 13, the air bags 16 to 19 are supplied with air from the pump 13 and inflated. The air is released from the air bags 16 to 19 when the bags communicate with the atmosphere. The feet of the user held in the cavities 15, 15 are pressed on their sides and relieved of the pressure for a massage by repeating such inflation and contraction.

Figure 2:
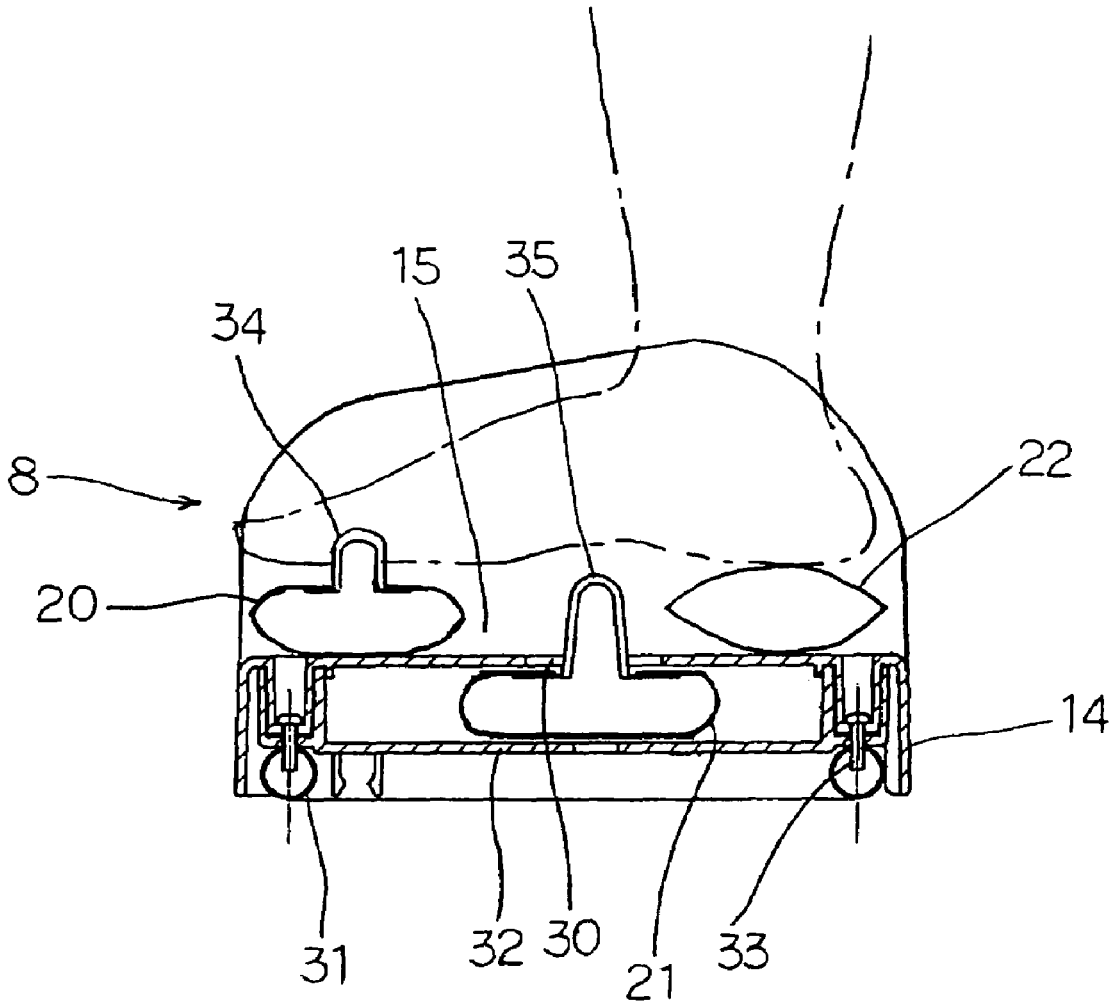
FIG. 2 is a view showing a footrest of the massage machine in vertical section taken along the front-rear direction of the foot, the sole which is the portion to be massaged being shown as raised, with side air bags omitted.
Figure 3:
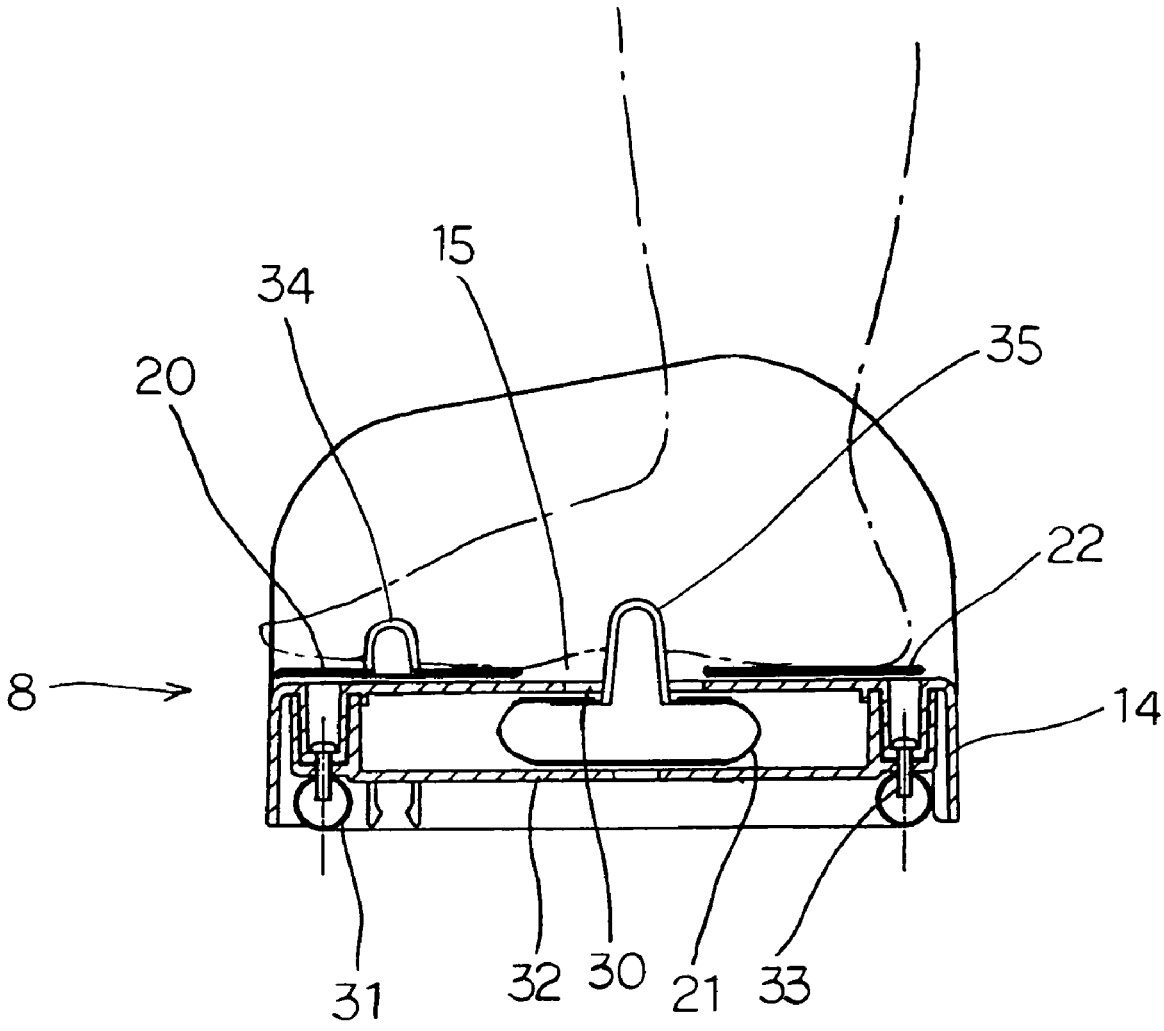
FIG. 3 is a view showing the footrest of the massage machine in vertical section taken along the front-rear direction of the foot, the sole being shown as lowered while being given a soft acupressure massage, with the side air bags omitted.

As shown in FIGS. 2 and 3, the bottom wall of each cavity 15 of the footrest has an opening 30. The unit case 14 is reinforced with a pipe frame 31 of metal provided on the rear side of the case for shaping the contour of the unit case 14. The pipe frame 31 is connected to the legrest 7 by an unillustrated link mechanism. A base plate 32 is attached to the rear side of the unit case 14. The base plate 32 is fastened to the pipe frame 31 with screws 33 along with the unit case 14.

The bottom wall of the cavity 15 of the footrest 8 is provided with three air bags 20, 21, 22 arranged in the front-rear direction (toe-to-heel direction) of the foot. The foremost air bag 20 (toward the toe) is used for the roots of the toes and positioned on the bottom wall of the cavity 15. The rearmost air bag 22 (toward the heel) is used for the heel and provided on the bottom wall of the cavity 15. The middle air bag 21 is used for the arch and provided between the bottom wall of the cavity 15 and the base plate 32.

Figure 4:
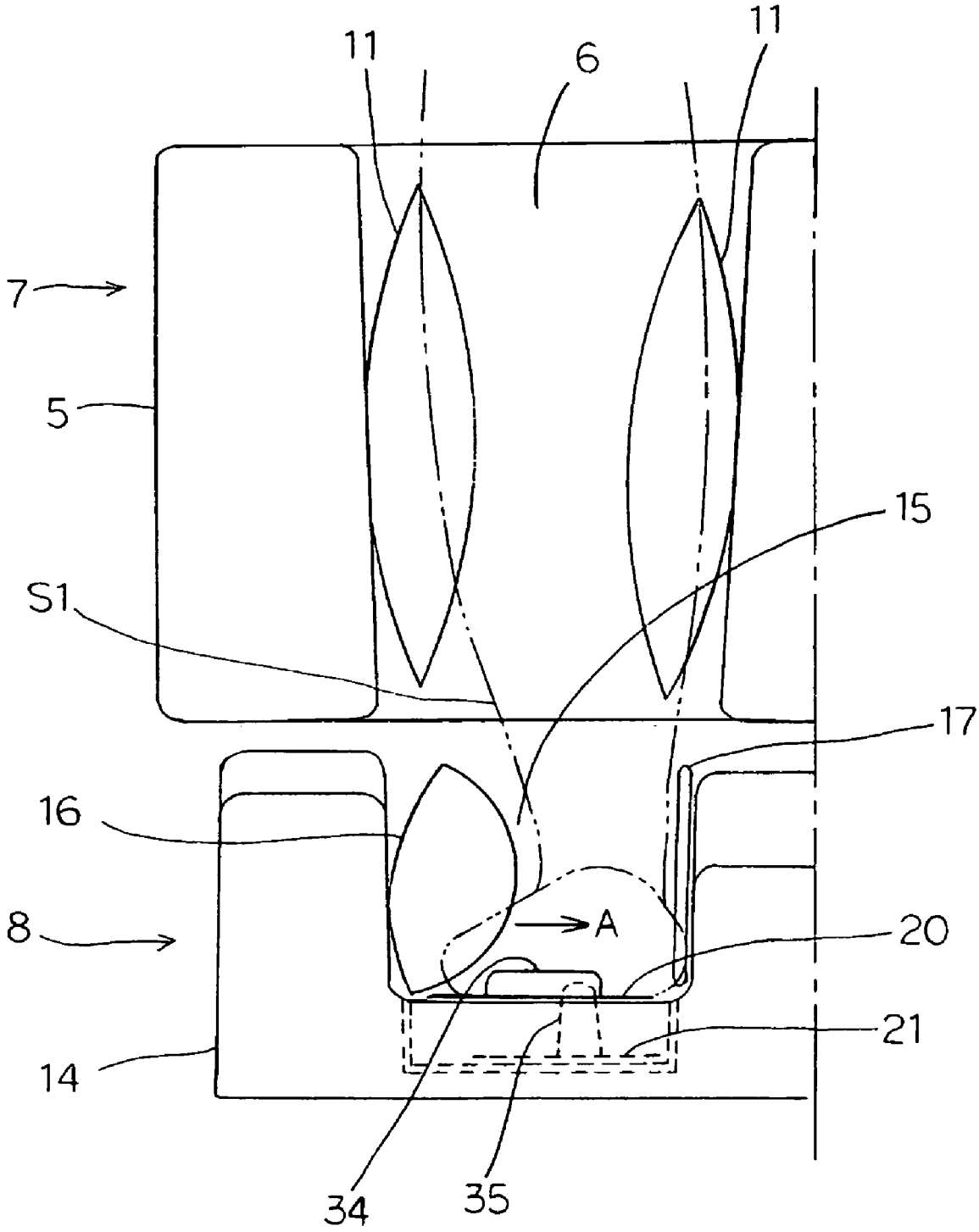
FIG. 4 is a schematic front view showing a legrest and the footrest of the massage machine, the leg being stretched on the outer side thereof.
Figure 5:
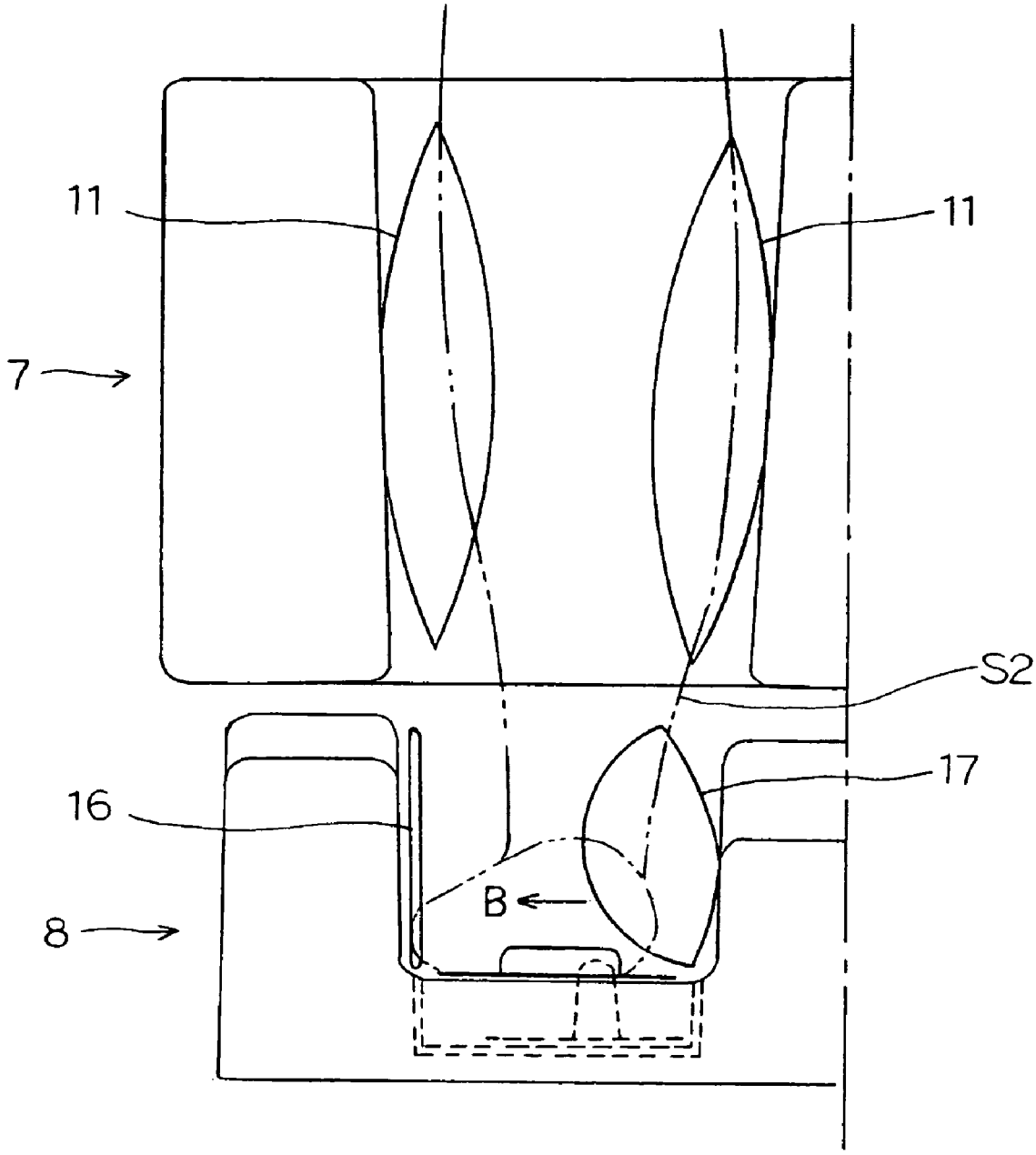
FIG. 5 is a schematic front view showing the legrest and the footrest of the massage machine, the leg being stretched on the inner side thereof.

Each of these three air bags 20 to 22 is made from a pair of upper and lower sheets each comprising a nylon fabric laminated with urethane by heat-sealing the sheets along their outer peripheries to obtain a bag. Of the three air bags, the air bag 20 for the roots of the toes and the air bag 21 for the arch are provided with acupressure projections 34, 35, respectively. These acupressure projections 34, 35 are each attached to the air bag by fitting the lower end of the projection into an aperture formed in the upper layer of the upper sheet and heat-sealing the projection end to the apertured portion. The acupressure projection 35 on the air bag 21 for the arch has a greater height than the acupressure projection 34 on the air bag 20 for the toe roots and is adapted to project from and retract into the opening 30 formed in the cavity bottom wall with the inflation and contraction of the air bag 21. As shown in FIGS. 4 and 5, the acupressure projection 35 on the air bag 21 for the arch is positioned inward from the center, with respect to the left-right direction, of the bottom wall of the cavity 15 in corresponding relation with the arch of the sole as placed in the cavity 15.

The three air bags 20 to 22 are connected to the air pump 13 respectively through piping tubes (not shown) and electromagnetic valves 27 to 29 (see FIG. 6). The valves 27 to 29 selectively cause the air bags 20 to 22 to communicate with the air pump 13 or with the atmosphere by blocking the communication of the bags with the pump. When communicating with the air pump 13, the air bags 20 to 22 are supplied with air from the pump 13 and inflated. The air is released from the air bags 20 to 22 when the bags communicate with the atmosphere.

When the air bag 21 for the arch is in a contracted state, the acupressure projection 35 is slightly projected from the opening 30, such that when the projection 35 is stepped on, the projection will not press on the sole strongly to give no pain thereto.

A cloth cover (not shown) is also provided over the footrest 8. With the cover provided over the surface, the side air bags 16 to 19 can be held along the side walls of the cavities 15 while being prevented from falling inside the cavities 15 without the necessity of securing the bags 16 to 19 to the side walls as by adhesion.

FIG. 6 is a diagram showing the connection between the air pump 13 and the air bags 11 and 16 to 22, and the relation between these components and control means 50. The electromagnetic valves 12 and 23 to 29 for controlling the supply of air to the air bags 11 and 16 to 22 are opened and closed with signals from the control means 50. When the valve is opened, air is supplied to the corresponding air bag, and when the valve is closed, the corresponding air bag is caused to communicate with the atmosphere. The control means 50 comprises a microcomputer and disposed at a suitable portion of the massage machine 10. In addition to the signals for opening and closing the valves, the control means 50 sends signals for driving or stopping the air pump 13 and also signals for controlling the massage unit 4 in the backrest 2.

The user is seated in the chair-type massage machine 10, with his or her legs (calves) placed into the cavities 6, 6 of the legrest 7 and with his or her feet placed into the cavities 15, 15 of the footrest 8. In this state, the electromagnetic valve or valves 12, or 23 to 26 are opened, and the air pump 13 is driven to inflate the four side air bags 11 of the legrest 7 or the side air bags 16 to 19 of the footrest 8, whereby the legs or feet of the user are pressed on. When the side air bags are contracted by closing the valve or valves 12 or 23 to 26, the pressure is removed. By repeating such inflation and contraction, the legs or feet can be massaged from opposite sides.

By individually opening and closing the electromagnetic valves 27 to 29, the three air bags 20 to 22 on the bottom of each cavity of the footrest 8 can be inflated and contracted repeatedly. An acupressure massage can be given to the roots of the toes and the vicinity thereof by inflating the toe root air bag 20, to the arch and vicinity thereof by inflating the arch air bag 21, and to the heel and the vicinity thereof by inflating the heel air bag 22.

When only the air bag 20 for the toe roots is inflated, the forward ends of the toes are raised, whereby the calf can be stretched out effectively. Especially when the leg is fixed and prevented from rising by being held between the side air bags 11 of the legrest 7 by inflating the bags 11, this effect is available more readily. Since the air bags 20 for the toe roots is positioned not under the bottom wall of the cavity 15 but on the bottom wall, the toe tips can be raised efficiency by inflating the air bag 20 for the toe roots to some extent. In other words, the acupressure projection 34 can be given a reduced height, with the result that the height can be such that even if the acupressure 34 is stepped on with the sole when the air bag is contracted, the sole can be free of pain.

Since the air bags 20 to 22 are made from a pair of upper and lower sheets by heat-sealing the outer peripheries thereof, these bags can be inflated quickly in response to the supply of air to give the acupressure massage described above to the sole by the air bags 20 to 22 more quickly and with greater pressure than when the bags are made by blow molding.

A soft acupressure massage is given in the manner to be described below.

The three air bags 20 to 22 are inflated at the same time by opening the corresponding electromagnetic valves 27 to 29 at the same time. These bags can be completely inflated in about two seconds, and the inflation of the bags raises the sole as shown in FIG. 2. The valves 27 to 29 remain open for about 2 seconds after completion of inflation, and the valves 27 and 29 corresponding respectively to the air bag 20 for the toe roots and the air bag 22 for the heel are thereafter closed, with the valve 28 corresponding to the air bag 21 for the arch subsequently held open. As a result, the air bags 20, 22 communicate with the atmosphere to start to contract slowly.

As the bags become contacted progressively, the sole held raised lowers under gravity, with the result that the acupressure projection 35 of the air bag 21 for the arch comes into contact with the arch. The completion of contraction of the air bags 20, 22 takes about 4 seconds, and the force given to the arch by the acupressure projection 35 gradually increases in the meantime. Consequently given to the arch is soft acupressure which feels like an incessantly pressing contact (see FIG. 3). Incidentally, the leg and foot are indicated in a chain line in FIGS. 2 and 3.

The two valves 27, 29 are thereafter opened again to inflate the air bags 20, 22 and raise the sole to repeat the above operation. Thus, the valves 27, 29 are opened and closed repeatedly every 4 seconds, with the valve 28 held open to give soft acupressure to the arch.

The electromagnetic valves 27, 29, although opened for 4 seconds, may be opened for 2 seconds since the air bags 20, 22 are completely inflated in about 2 seconds. This ensures effective use of time. To inflate the air bags 20 to 22 quickly in response to the supply of air, the each bag is made from a pair of upper and lower sheets by heat-sealing the outer peripheries thereof. To effectively utilize this feature of the air bag, it is desirable to effectively utilize time by shortening the opening time for the valves 20, 22.

Although the valves 27, 29 are closed for 4 seconds so as to completely contract the air bag 20 for the toe roots and the air bag 22 for the heel, the closing time for the valves 27, 29 can be shortened to permit these bags to contract only to an intermediate extent. This diminishes the force to be given to the arch by the acupressure projection 35 of the air bag 21 for the arch.

Although the machine is adapted to give soft acupressure with the acupressure projection 35 of the air bag 21 for the arch, soft acupressure is similarly available by the acupressure projection 34 of the air bag 20 for the toe roots. In this case, the electromagnetic valves 28, 29 corresponding to the air bags 21 for the arch and the air bag 22 for the heel are repeatedly opened and closed, with the valve 27 corresponding to the toe root air bag 20 held open.

Since the soft acupressure described is given by utilizing the gravity acting on the part to be massaged when considered from a different viewpoint, a plurality of air bags can be provided on the bottom of a cavity for placing in a different part of the body other than the sole, such as the arm, for giving soft acupressure.

When the legrest 7 is pivotally moved to approximately the same level as the seat 1, each calf will be supported by the bottom wall of the cavity 6. If the bottom wall of the cavity 6 of the legrest 7 is also provided with a plurality of air bags which operate in the same manner as above, a soft acupressure massage can be given to the calf, with the legrest 7 pivotally moved to approximately the same level as the seat 1.

With massage machines adapted for an automatic course wherein predetermined massage operations are programmed in advance, such a soft acupressure massage may be incorporated into the final stage of the automatic course. This gives an enhanced effect to relax the person to be massaged.

With reference to FIGS. 4 and 5, a description will be given of a massage for stretching the side of the leg (the side of the calf to the neck of the foot) which is characteristic of the invention. Although the stretching massage operation will be described with reference to one of the pair of legs (right leg) for the sake of convenience, the same operation is performed for the other leg. The leg and the foot are indicated in chain lines in FIGS. 4 and 5.

The side air bags 11, 11 on opposite side walls of the gutterlike cavity 6 of the legrest 7 are inflated by opening the electromagnetic valve 12 to hold the leg of the user between the two air bags 11 as shown in FIGS. 4 and 5. In this state, the side air bags 16, 17 on opposite side walls of the cavity 15 of the footrest 8 are inflated and contracted alternately.

In the case of FIG. 4, the side air bag 16 provided on the outer side wall of the cavity 15 is inflated by opening the valve 23, while the side air bag 17 provided on the inner side wall is allowed to communicate with the atmosphere by closing the valve 24. As a result, the foot is pushed inward by the air bag 16 as indicated by the allow A in the drawing. With the calf held between the air bags 11 as stated above, this movement of the foot stretches the muscle on the outer side S1 of the leg.

In the case of FIG. 5, the side air bag 17 provided on the inner side wall of the cavity 15 is inflated by opening the valve 24, while the side air bag 16 provided on the outer side wall is allowed to communicate with the atmosphere by closing the valve 23. As a result, the foot is pushed outward by the air bag 17 as indicated by the allow B in the drawing. With the calf held between the air bags 11 as stated above, this movement of the foot stretches the muscle on the inner side S2 of the leg.

The leg can be stretched alternately on the inner side and outer side laterally by repeating the states of FIGS. 4 and 5.

For example, the electromagnetic valves 23, 24 are operated in the cycle of opening only the valve 23 for 2 seconds when the two valves 23, 24 are in a closed state (with the air bags 16, 17 contracted) to inflate the air bag 16 [to stretch the outer side S1 of the leg (FIG. 4)], then opening the valve 24 also for 2 seconds to inflate the air bag 17 also (to press on opposite sides of the foot), thereafter closing the valve 23 for 2 seconds to contract the air bag 16 [to stretch the inner side S2 of the leg (FIG. 5)], subsequently opening the valve 23 to inflate the air bag 16 (to press on opposite sides of the foot) and thereafter closing the valve 24 to contract the air bag 17 [to stretch the outer side S1 of the leg (FIG. 4)]. The same is true of the valves 25, 26.

Since the side walls of the pair of cavities 15, 15 of the footrest 8 are provided with the respective air bags 16 to 19 which inflate and contract independently of one another, for example, the legs can be stretched at the same time both on the inner side (outer side), or one of the legs can be stretched on the inner side (outer side) with the other leg stretched on the outer side (inner side) by combinations of inflation and contraction of the individual air bags.

Although the side air bags 11 provided on opposite side walls of each cavity 6 are used as means for holding the leg as placed in the legrest 7, the side air bag 11 may alternatively be provided on only one side wall of the cavity 6, with an expanded resin or like elastic body provided on the other side wall, such that the side air bag on one side wall is inflated to push the leg toward the elastic body and hold the leg with the side air bag and the elastic body.

In either case, the side air bag or bags are repeatedly inflated and contracted to massage the leg as stated above.

Instead of using the side air bags, it is possible to provide holding plates along the respective side walls of the cavity 6 and to move the holding plate in the leftward or rightward as by a motor for the holding plates to hold the leg therebetween.

Although side air bags 16 to 19 are used as means for moving the foot toward one of the side walls of each cavity 15, it is possible to provide moving plates along the respective side walls of the cavity 15, move the plate in the leftward or rightward as by a motor and thereby move the foot toward one side wall.

Apparently the present invention can be altered or modified by one skilled in the art without departing from the spirit of the invention, and such modification is included within the scope of the invention as set forth in the appended claims.

For example, the legrest 7, which serves also as a massage unit for the legs, may have only the function of holding the legs.

What is claimed is:

1. A massage machine comprising:

a legrest provided in front of a seat of a chair for the user to place his or her legs thereinto, the legrest having a pair of gutterlike cavities each defined by side walls and for the user to place his or her legs thereinto;

a footrest provided at a forward end of the legrest for the user to place his or her feet thereinto, the footrest having a pair of gutterlike cavities for the user to place his or her feet thereinto;

leg holding means comprising side air bags provided on the side walls of the legrest for holding each leg of the user therebetween from opposite sides thereof, the side air bags being inflatable and contractable by being supplied with air and releasing the air therefrom;

a first valve connected to the side air bags of the leg holding means;

foot moving means comprising two side air bags arranged on respective opposite side walls defining each of the cavities of the footrest and for moving each foot of the user leftward or rightward, the side air bags being inflatable and contractable by being supplied with air and releasing the air therefrom;

a second valve connected to one of the side air bags of the foot moving means;

a third valve connected to the other of the side air bags of the foot moving means;

an air pump in communication with the side air bags of the leg holding means through the first valve and with the side air bags of the foot moving means through the second and third valves; and control means for controlling the operation of said each first, second and third valves and the air pump, the control means being structured to drive the air pump, to open the first valve to keep the side air bags of the leg holding means in an inflated state, and the control means being structured to alternately open and close the second and third valves to selectively inflate and deflate individually each of the side air bags of the foot moving means alternately and independently of one another, to thereby move the foot of the user leftward or rightward, with the leg held by the leg holding means, to stretch the leg of the user.

2. The massage machine according to claim 1, wherein the footrest is provided on a bottom wall thereof with at least one acupressure projection.

* * * * *